United States Patent [19]

Swanson

[11] 4,306,675

[45] Dec. 22, 1981

[54] ARTICLE DIVIDER FOR BOXES

[75] Inventor: John L. Swanson, St. Paul, Minn.

[73] Assignee: Central Container Corporation, Minneapolis, Minn.

[21] Appl. No.: 165,039

[22] Filed: Jul. 1, 1980

[51] Int. Cl.[3] ..... B65D 5/48

[52] U.S. Cl. ..... 229/42; 206/150; 428/134; 428/136

[58] Field of Search ..... 229/42, 15; 217/7, 8, 217/21, 27, 35; 206/523, 590, 591, 150; 428/134, 136

[56] References Cited

U.S. PATENT DOCUMENTS

| | | | |
|---|---|---|---|
| 347,324 | 8/1886 | Cramer | 229/42 |
| 2,319,225 | 5/1943 | Grelic | 428/136 |
| 3,655,501 | 4/1972 | Tesch | 428/136 |
| 3,912,159 | 10/1975 | Danville | 229/42 |
| 3,966,044 | 6/1976 | Cunningham | 206/150 |
| 4,136,771 | 1/1979 | Owen | 206/150 |

*Primary Examiner*—Herbert F. Ross
*Attorney, Agent, or Firm*—H. Dale Palmatier

[57] ABSTRACT

A grid-like article divider for packing cartons, of foamed plastic such as polyurethane or polyethylene, the divider having spaced parallel stringer panels and transverse panels hinged to the longitudinal panels, the divider being formed in collapsed condition from a solid slab of foamed plastic which is die cut with slits or cleavage to define the side faces of all of the longitudinal and transverse panels and holes, and with hinging sections arranged so that the plugs deformed at the holes drop out and the ends of the transverse panel swing against the longitudinal panels in the grid-like divider.

15 Claims, 7 Drawing Figures

ARTICLE DIVIDER FOR BOXES

This Invention relates to an article divider for packaging cartons and to the method of making such article dividers.

BACKGROUND OF INVENTION

For the most part article dividers used in packaging cartons have been made out of heavy paper or corrugated cardboard. Such corrugated cardboard has been cut in strips, notched at the sides and assembled together in nested relation. Such cardboard dividers are very unattractive.

Limited use has been made of foam plastics, such as polyethylene foam. Although some of the foam plastics are available in bright colors and may have an appealing appearance, known plastic dividers have not been made to have an ornamentally attractive physical construction.

SUMMARY OF THE INVENTION

An object of the Invention is to provide a new and improved article divider for packaging cartons of simple and inexpensive construction.

Another object of the invention is to provide a novel method of forming article dividers to permit such dividers to be inexpensively manufactured and to have attractive ornamental appearance.

A further object of the Invention is to provide an improved article divider construction whereby the panels of the divider may be oriented at desired locations and whereby the divider may be inexpensively formed by die cutting from a slab of foamed plastic.

A still further object of the Invention is the provision of an improved method of die cutting a slab of foamed plastic in such a manner that the slab may be expanded into a grid with panels and openings for articles.

A feature of the Invention is an article divider which is die cut from a slab of foam plastic, wherein the slab is slit and punched to form longitudinal and transverse panels which may swing on hinging areas of the plastic into perpendicular relation to each other and also to eject punched out waste or slugs as the slab is folded out into the grid shape of the divider.

Another feature of the invention is the method of forming the article divider from a slab of foam plastic by die cutting the slab along parallel lines to define parallel panels and punching alternate panels to form hinging areas to permit adjacent panels to swing normal to each other.

The article divider may be formed of any of a plurality of different foam type plastics such as polyethylene foam or polyurethane foam; and the foam material may vary widely in consistency from a very soft and highly compressible foam material to a relatively stiff and inflexible foam material. Most such foam plastics are quite resilient in nature and permit significant compression during the die cutting, and allow the plastic to resiliently return to its original shape.

The principal advantages of the invention are to form article dividers inexpensively from foam plastic which will be visually attractive and functional to separate and cushion adjacent articles relative to each other in a carton, and wherein the article openings may be square or rectangular or similar shapes to accommodate articles of various sizes and proportions. In addition, the present invention significantly reduces the amount of material needed to form a conventional rigid grid system and therefore greatly decreasing the amount of waste.

DESCRIPTION OF THE DRAWINGS

FIG. 1 is a top plan view of the divider to be inserted into a carton or box.

FIG. 2 is a detail view taken along a broken line as indicated at 2—2 in FIG. 1.

FIG. 3 is a top plan view of the die cut slab of foam plastic to be formed into the article divider.

DETAIL SPECIFICATION

Figures 4, 5, 7, 8, 9:
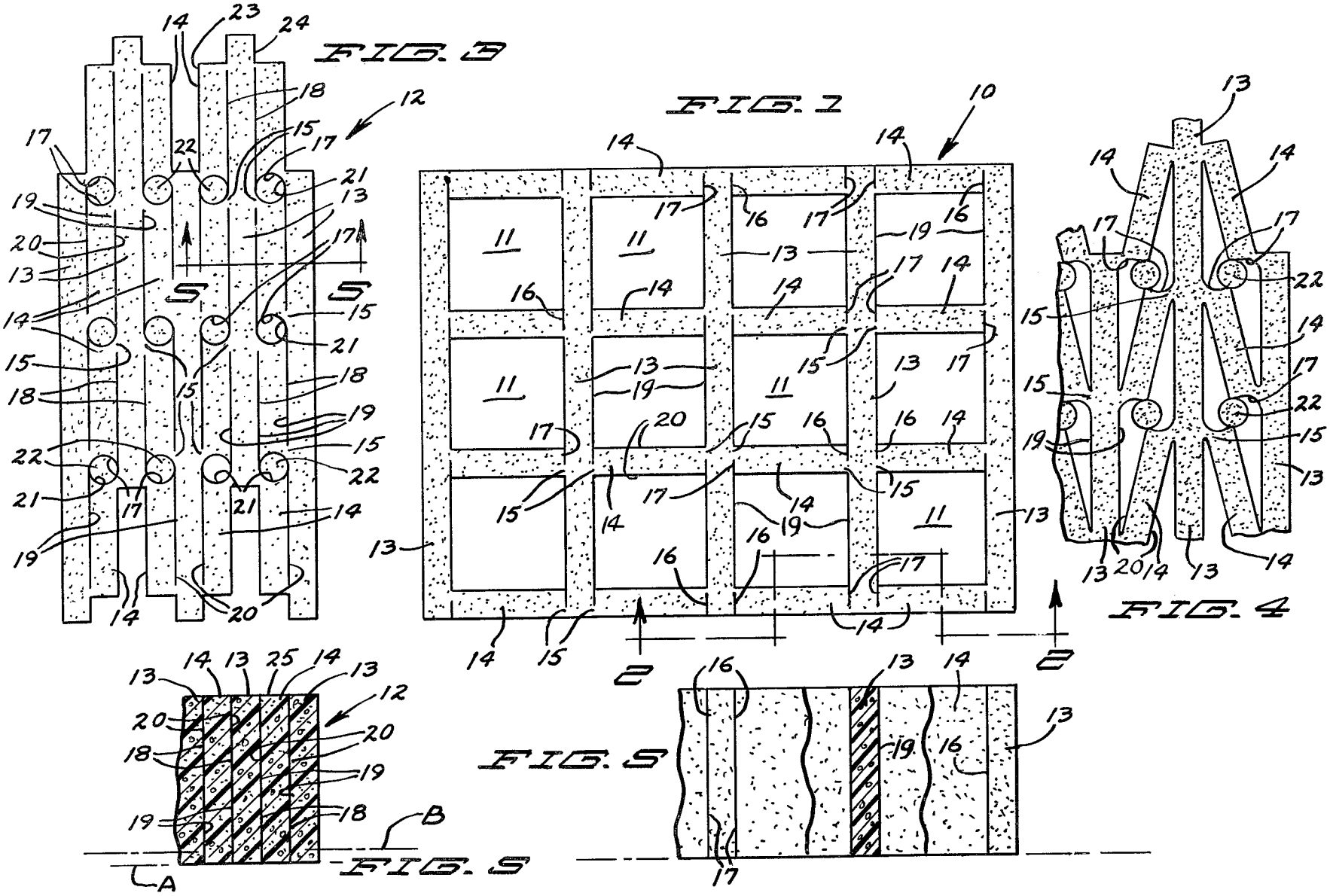
FIG. 4 is an enlarged detail plan view showing the die cut slab partially opened.
FIG. 5 is a detail section view taken approximately at 5—5 of FIG. 3.
FIG. 7 is a detail plan view of a slab of foamed plastic die cut for forming the grid of FIG. 6.

In the form of the invention illustrated in FIGS. 1–5, a grid-like article confining divider 10 has a multiplicity of article receiving openings 11 which are substantially square.

The formed slab 12 of foamed plastic from which the divider 10 is formed is illustrated in FIG. 3.

The article divider 10 has a multiplicity of elongate longitudinal or stringer panels 13 extending between the ends of the divider.

The divider 10 also includes a multiplicity of transverse or connector panels which extend transversely of the longitudinal panels 13. The connector panels confront each other and cooperate with the longitudinal panels 13 in defining the article confining openings 11. The longitudinal and transverse panels 13 and 14 are formed in one piece and integrally of each other and are interconnected by a multiplicity of hinging sections 15 located at the both ends of each of the transverse panels 14.

It should be recognized that the hinging sections 15 extend only across a fraction of the thickness of the transverse panels 14. There is a cleavage 16 at each end of each of the transverse panels 14 immediately adjacent the adjoining hinging section and extending a distance which is partially through the thickness of the transverse panels 14. The end edges 17 of the transverse panels 14 abut the adjacent longitudinal panels 13 without any significant deformation or compression of the material in the transverse panels 14.

When the divider 10 is inserted into a carton to receive articles in the openings 11 thereof, the grid-like shape of the divider 10 is maintained because of the restraining influence of the walls of the carton. Whereas the natural resilience of the foamed plastic material in the divider tends to move adjacent longitudinal panels 13 in opposite longitudinal directions, this movement is restrained by the carton.

The slab of foamed plastic, such as polyurethane or polyethylene or other similar foamed materials, is illustrated in FIGS. 3 and 5.

The slab 12 is die cut to define slits or cleavage 18 in a multiplicity of locations as to define the multiplicity of stringer panels 13 and connector panels 14. The stringer panels 13 in slab 12 are the same as the longitudinal stringer panels 13 found in the divider after the slab is expanded as hereinafter more fully pointed out; and the connector panels 14 of the slab 12 are the same as the transverse or connector panels 14 in the divider 10 after the slab 12 is expanded into the divider.

It will be seen that the stringer panels 13 extend, uninterruptedly between the ends of the slab 12, and the slits or cleavage 18 define the side faces 19 of the panels 13. The slits or cleavage 18 also define the side faces 20 of the connector panels 14. At the ends of the several connector panels 14, cylindrical holes 21 are die cut or punched, leaving the cylindrical plugs 22 in the cut holes. It will be seen that the periphery of each of the die cut or punched holes 21 intersects with a pair of the adjacent slits or cleavage 18 at diametrically opposite locations of the hole so as to allow a complete separation between the adjacent stringer and connector panels 13 and 14 at these locations.

The peripheries of the die cut or punched holes 21 are also spaced from an adjacent pair of cleavage or slits 18 at each of the holes, as seen at 15 to define the hinging sections which correspond to the hinging sections 15 in the divider 10 of FIG. 1 which is expanded from the slab 12 of FIG. 3.

It should be recognized that the holes 21 are substantially cylindrical in the form illustrated and have a width or diameter which is substantially the same as the thickness of the connector or transverse slabs 14. The peripheries of the holes 21 also define the transverse end edges of the connector or transverse panels 14 after the slab is expanded into the grid-like divider 10.

In the slab 12, the plugs 22 perform a valuable function of contributing materially to holding the slab in constricted condition until such time as it is desired to open up the slab and expand the slab into the divider 10.

When the slab 12 is to be expanded into the divider, the longitudinal or stringer panels 13 are moved transversely relative to each other, in the manner illustrated in FIG. 4. As this occurs, the connector or transverse panels 14 commence swinging from their position illustrated in FIG. 3 wherein they lie parallel to the stringer panels 13, to an initially oblique relationship to the stringer panels as illustrated in FIG. 4. As the relative transverse movement of the stringer panels 13 occurs, the plugs 22 are caused to roll out of their original positions and across the transverse end edges 17 of the adjacent connector panels 14.

As the expansion of the slab 12 continues beyond the position illustrated in FIG. 4 and toward the fully expanded position illustrated in FIG. 1, it will be understood that the plugs 22 simply drop out and in that respect the plugs are considered to be self stripping.

As the connector panels 14 assume a position which is approximately perpendicular to the stringer or longitudinal panels 13, the end edges 17 will bear or abut against the adjacent stringer or longitudinal panels 13. The end edges 17 are somewhat arcuate in shape, and accordingly there is a small but insignificant amount of compressive deformation of the material in the ends of the connector panels 14 immediately adjacent the hinging sections 15, but the very limited compressive deformation has virtually no effect on the opening or operation of the grid-like divider. The end result is the grid-like divider illustrated in FIG. 1 wherein all of the openings 11 are of the same shape and dimensions and are in this instance square.

It will be recognized in FIG. 3 that the end contour of the slab 12 in the original shape is recessed at 23 and has a small protuberance at 24 to accommodate the shapes of the several panels, and the progressive opening of the slab into the final shape as illustrated.

It will also be recognized that in the event it is desired to reuse the divider 10 after it has been initally used, the divider in constrictible into small compass and substantially back into the original shape of the slab 12 so that the divider may be shipped to a place of origin, or conveniently stored for reuse.

Figure 6:
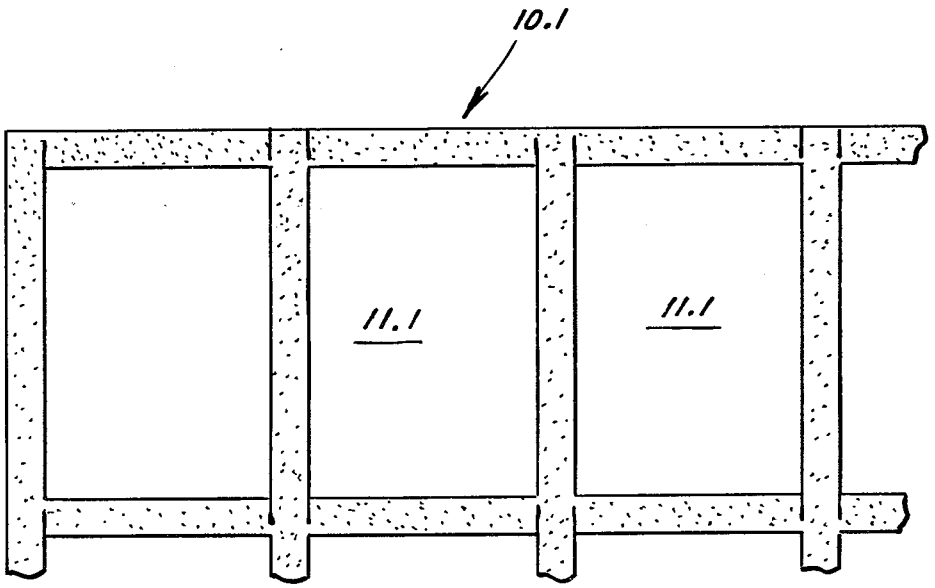
FIG. 6 is an enlarged detail plan view of modified form of the article divider.
Figure 7:
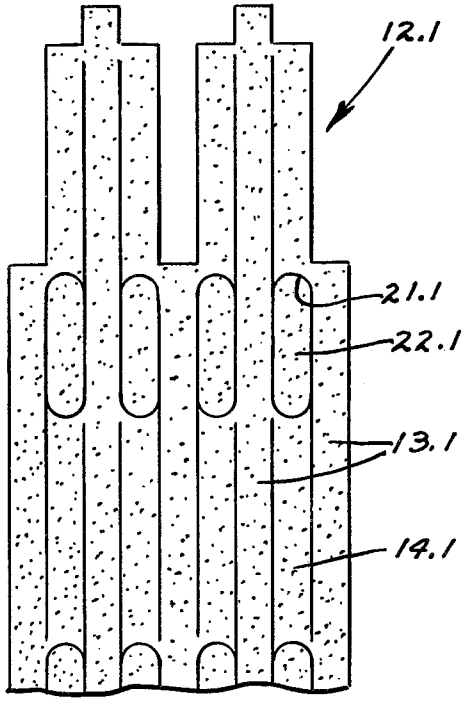

In the form of the invention illustrated in FIGS. 6 and 7, the divider 10.1 is substantially identical to the divider 10 of the FIG. 1; and the slab 12.1 from which the divider 10.1 is formed is essentially the same as the slab 12 of FIG. 3. In FIG. 6, the divider 10.1 has openings 11.1 which are of rectangular shape wherein the sides of the rectangular openings are of unequal dimensions. Accordingly, the openings 11.1 are not square as those of FIG. 1. The openings 11.1 may be considered to be of parallelogram shape, in this instance wherein all the sides of the parallelogram are at right angles to each other, but the shape could be such that the sides of the parallelogram are oblique to each other.

The entire construction of the divider 10.1 is identical to divider 10 except for the shape of the openings 11.1. In the slab 12.1, the construction is identical to that previously described in connection with FIGS. 3 and 4 with exception that the holes 21.1 have an oblong shape rather than a circular shape as illustrated in FIG. 3. The width of the oblong shape is the same as the thickness of the connector panels 14.1; and the length of the oblong shape of the holes 21.1 extends parallel to the connector panels 14.1 and the adjacent longitudinal or stringer panels 13.1. It is the length of the oblong shape of the holes 21.1 which causes the openings 11.1 to have a rectangular shape rather than a square shape as illustrated in FIG. 1. If holes 21 were made longer than those illustrated in FIG. 7, the length, width ratio of the openings 11.1 would be substantially greater than that illustrated in FIG. 6.

Whereas, the holes 21 of the slab 12 are conveniently formed by punching, the holes 21.1 in the slab 12.1 are more easily formed by die cutting. The elongate plugs 22.1 contribute materially to holding the slab 12.1 in constricted condition until it is desired to expand the slab into the grid-like divider 10.1 as previously illustrated. During opening of the slab and forming of the divider 10.1, the plugs 22.1 will drop out by any manner identical to that previously described in connection with FIG. 4.

It will be recognized that in the die cutting process of the slabs 12 and 12.1, the resiliently compressible plastic foam is initially compressed into a substantially compact state, and while the slab is compressed, the cutting is performed. References invited to FIG. 5 wherein it is illustrated that during the die cutting, the base of the slab is maintained at the level A; and the entire slab 12 is compressed so that the top surface or face 25 is moved downwardly to approximately the plane B, at which time the die cutting occurs. When the slab is subsequently released, it resiliently returns to the thickness illustrated in FIG. 5. Die cutting of the slab 12.1 of FIG. 7 is similarly accomplished.

It will be recognized that the application describes an improved method of forming a grid-like article divider from a slab of foamed plastic such as polyurethane or polyethylene. The method includes the steps of die cutting the slab to define a multiplicity of juxtaposed stringer panels 13 by slits or cleavage 18 to define the side faces of a multiplicity connector panels which confront the side face of each of the stringer panels; and producing a multiplicity of holes between the ends of adjacent connector panels wherein the holes intersect the adjacent slits at first diametrically opposite locations of each hole and wherein the holes fail to intersect the other adjacent slits at the other diametrically opposite locations of each hole. Accordingly the slab may then be expanded by moving the stringer or longitudinal panels transversely of each other, causing the connector or transverse panels to swing out into normal or perpendicular relation to the stringer panel.

It will be seen that I have provided a new and improved article divider of foamed plastic such as polyurethane or polyethylene and wherein the divider includes longitudinal panels and transverse panels which cooperate to define the article confining openings in the grid-like divider; and the divider is formed from a slab which is die cut to allow the panels to be moved transversely or expanded into the shape of the grid-like divider. As described, a new method has been devised for forming the grid-like divider from a slab of foamed plastic.

What is claimed is:

1. A grid like divider for separating articles from each other when packed into a carton, comprising a multiplicity of elongate longitudinal panels on edge and in spaced and confronting relation to each other, and a multiplicity of transverse panels extending transversely of and between adjacent longitudinal panels in a grid like arrangement and defining article confining openings, the longitudinal panels and the transverse panels being integral and in one piece with each other and being formed of foamed plastic, there being hinging sections of the plastic at both ends of each of the transverse panels, the hinging sections having a thickness substantially less than the thickness of the panels.

2. The divider according to claim 1 wherein the end edges of the transverse panels about the longitudinal panels adjacent the hinging sections and without significantly deforming the end edges of the transverse panels.

3. The divider according to claim 1 wherein the transverse panels have side faces, the hinging sections at each end of each transverse panel being disposed adjacent one of said side faces, all of the hinging sections being disposed adjacent corresponding side faces of the transverse panels, whereby all of the transverse panels along one of the longitudinal panels may swing in the same direction relative to the adjacent longitudinal panel.

4. The divider according to claim 1 wherein the article confining openings are substantially rectangular in shape.

5. The divider according to claim 4 wherein the article confining openings are substantially square in shape.

6. The divider according to claim 1 wherein the article confining openings are shaped as a parallelogram.

7. The divider according to claim 1 wherein the transverse panels have side faces, there being a cleavage partially through the thickness of each transverse panel from one side face thereof and at each end edge thereof and adjacent the longitudinal panel and adjacent the corresponding hinging sections.

8. A formed slab of foamed plastic for forming a grid-like article divider, wherein the slab has ends and sides and a thickness, the slab having cleavage means through the thickness of the slab and defining a multiplicity of stringer panels and connector panels, the stringer panels extending between the ends of the slab and alternating in the slab between connector panels, the stringer panels having opposite faces each confronting and connected to a plurality of connector panels by hinging sections spaced from each other along the length of the stringer panels, the cleavage means defining a plurality of relief holes extending through the thickness of the slab and located between the ends of adjacent connector panels, each hole adjoining a pair of adjacent hinging sections, whereby to facilitate forming a grid-like article divider as the stringer panels are moved transversely apart and the connector panels are swung transversely therebetween.

9. The formed slab according to claim 8 wherein the cleavage means comprise die cuts along the faces of the stringer panels.

10. The formed slab according to claim 8 wherein the holes have a width substantially the same as the thickness of the connector panels.

11. The formed slab according to claim 10 wherein the holes have an oblong shape with a length extending parallel to the adjacent stringer panels, whereby the openings in the grid-like divider will be rectangular.

12. The formed slab according to claim 9 wherein the die cut slab includes plugs in the holes and conforming to the shape and size thereof.

13. The formed slab according to claim 12 wherein the holes and plugs are substantially cylindrical in shape, the plugs contributing materially to retaining the die cut slab in constricted condition until the slab is intentionally expanded into the grid shape, the plugs being self stripping by rolling out of their original positions as the slab is expanded to form the grid-like divider.

14. The invention according to either of claims 1 or 8 wherein the plastic material is foamed polyurethane.

15. The invention according to either of claims 1 or 8 wherein the plastic is foamed polyethylene.

* * * * *